US005149102A

United States Patent [19]

McGowan et al.

[11] Patent Number: 5,149,102

[45] Date of Patent: Sep. 22, 1992

[54] APPARATUS AND METHOD OF PLAYING A MATH GAME

[75] Inventors: Bernard W. McGowan, 8205 Brownsville, Bethany, Okla. 73008; Stephen P. Scully, Fort Lauderdale, Fla.

[73] Assignee: Bernard W. McGowan, Oklahoma City, Okla.

[21] Appl. No.: 765,216

[22] Filed: Sep. 23, 1991

[51] Int. Cl.[5] ..... A63F 3/00

[52] U.S. Cl. ..... 273/258; 273/272; 273/284; 273/287; 273/291

[58] Field of Search ..... 273/258, 242, 260, 272, 273/284, 287

[56] References Cited

U.S. PATENT DOCUMENTS

| | | | |
|---|---|---|---|
| 574,192 | 12/1896 | Climenson | 273/260 |
| 1,405,988 | 2/1922 | Erwin | 273/260 |
| 1,529,987 | 3/1925 | Buker et al. | 273/260 |
| 1,532,069 | 3/1925 | Ortiz et al. | 273/287 |
| 2,230,178 | 1/1941 | Campbell | 273/284 |
| 2,614,842 | 10/1952 | Rice | 273/258 |
| 2,709,124 | 5/1955 | Wales | 273/287 |
| 3,152,806 | 10/1964 | Jackman | 273/272 |
| 3,591,182 | 7/1971 | Grubler | 273/284 |

*Primary Examiner*—Benjamin H. Layno

*Attorney, Agent, or Firm*—Dunlap, Codding & Lee

[57] ABSTRACT

A math game having a game board with a plurality of defined spaces comprising goals. Some of the goals have goal playing math indicia associated with such goals. The math game includes playing pieces and each playing piece has a playing math indicia associated therewith. The players move the playing pieces to define goals and a score is determined by combining the goal playing math indicia on the game board with the playing math indicia on the playing piece.

18 Claims, 14 Drawing Sheets

APPARATUS AND METHOD OF PLAYING A MATH GAME

RELATED REFERENCES

This application is filed simultaneously herewith a design application for a game board.

FIELD OF THE INVENTION

The present invention relates generally to games and, more particularly, but not by way of limitation, to a math game where playing pieces are moved to goals on a game board and a score is determined by combining goal math indicia associated with the various goals with playing math indicia associated with the playing pieces.

DESCRIPTION OF THE PREFERRED EMBODIMENTS

Figure 1:
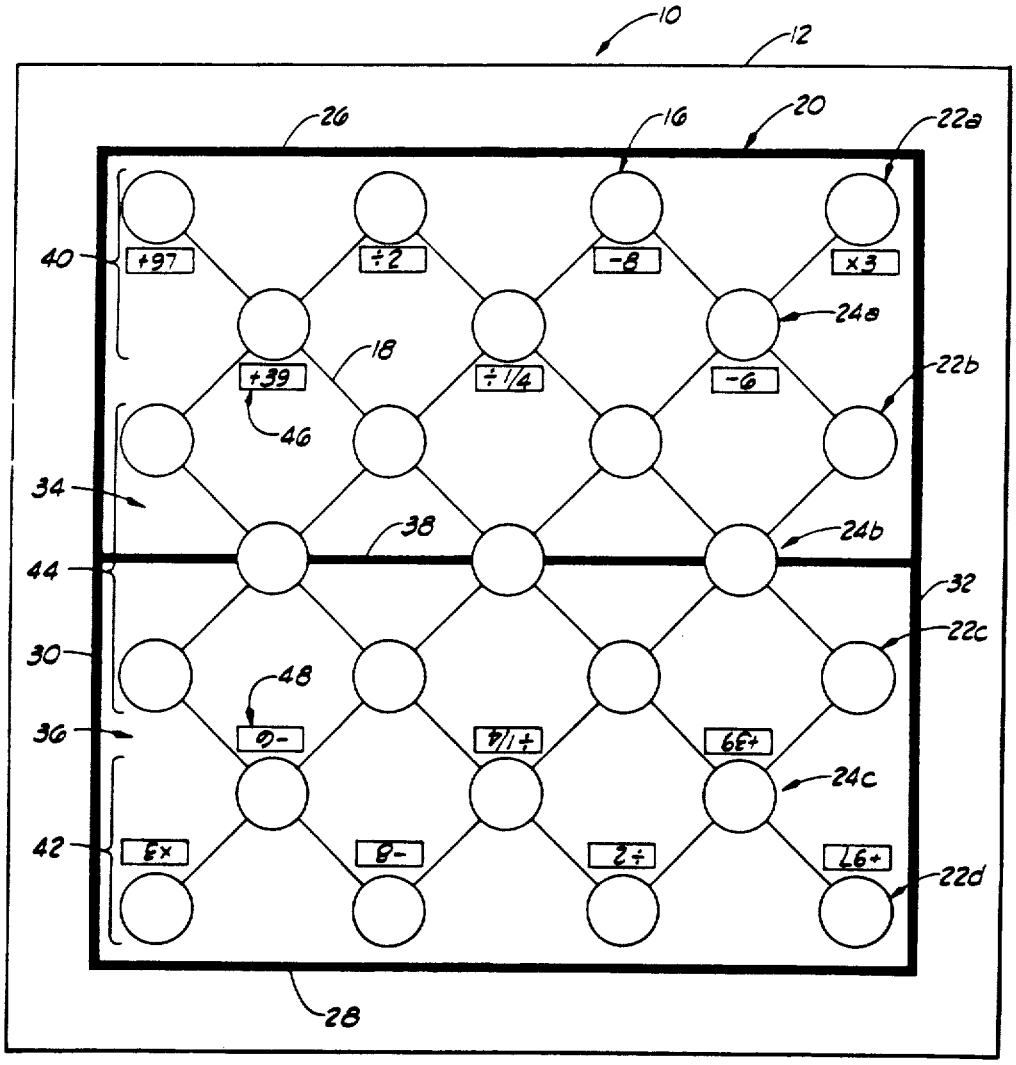
FIG. 1 is a top plan view of a game board constructed in accordance with the present invention with the playing pieces removed therefrom.
Figure 2:
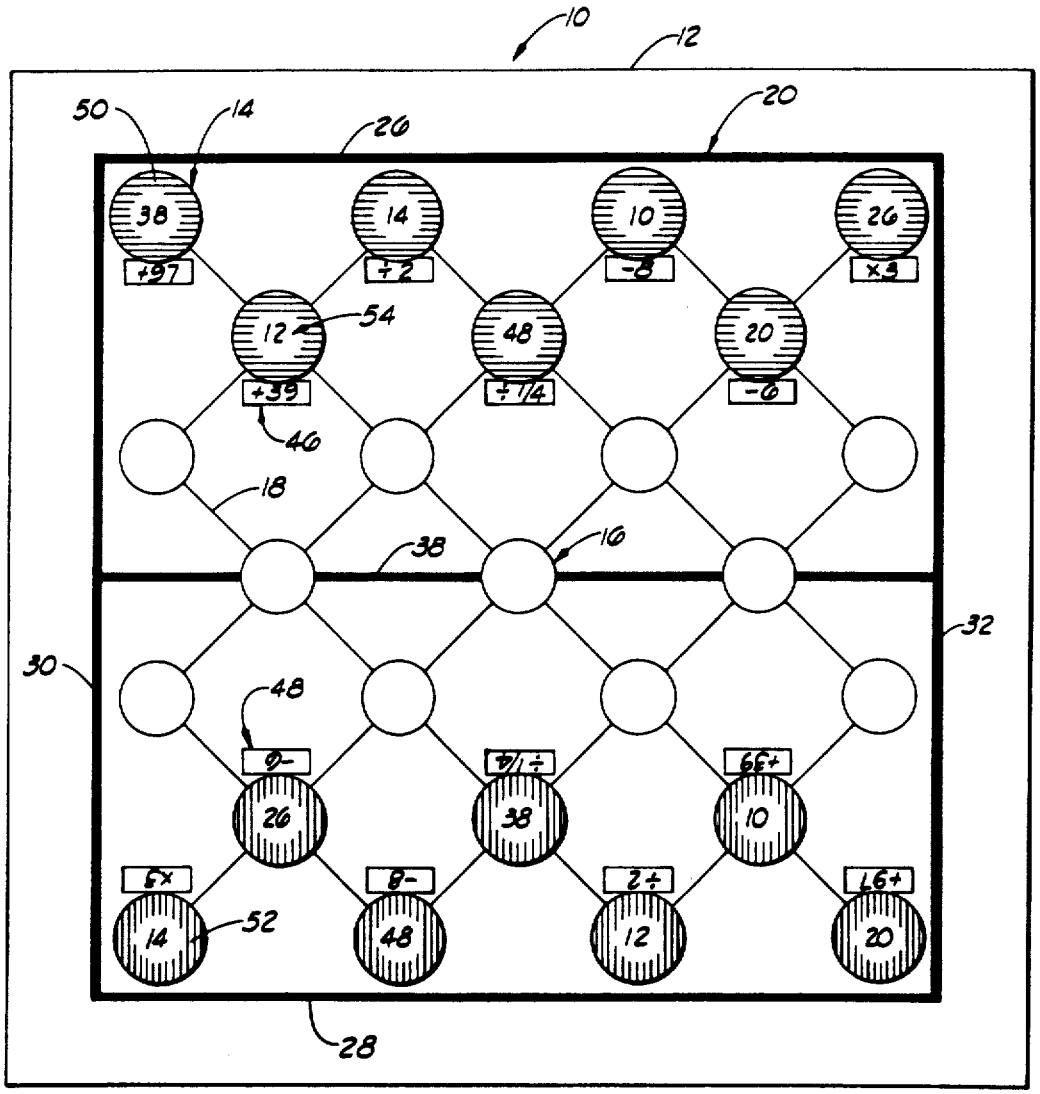
FIG. 2 is a top plan view of the game board of FIG. 1 showing the playing pieces in a start of game position.
Figure 3:
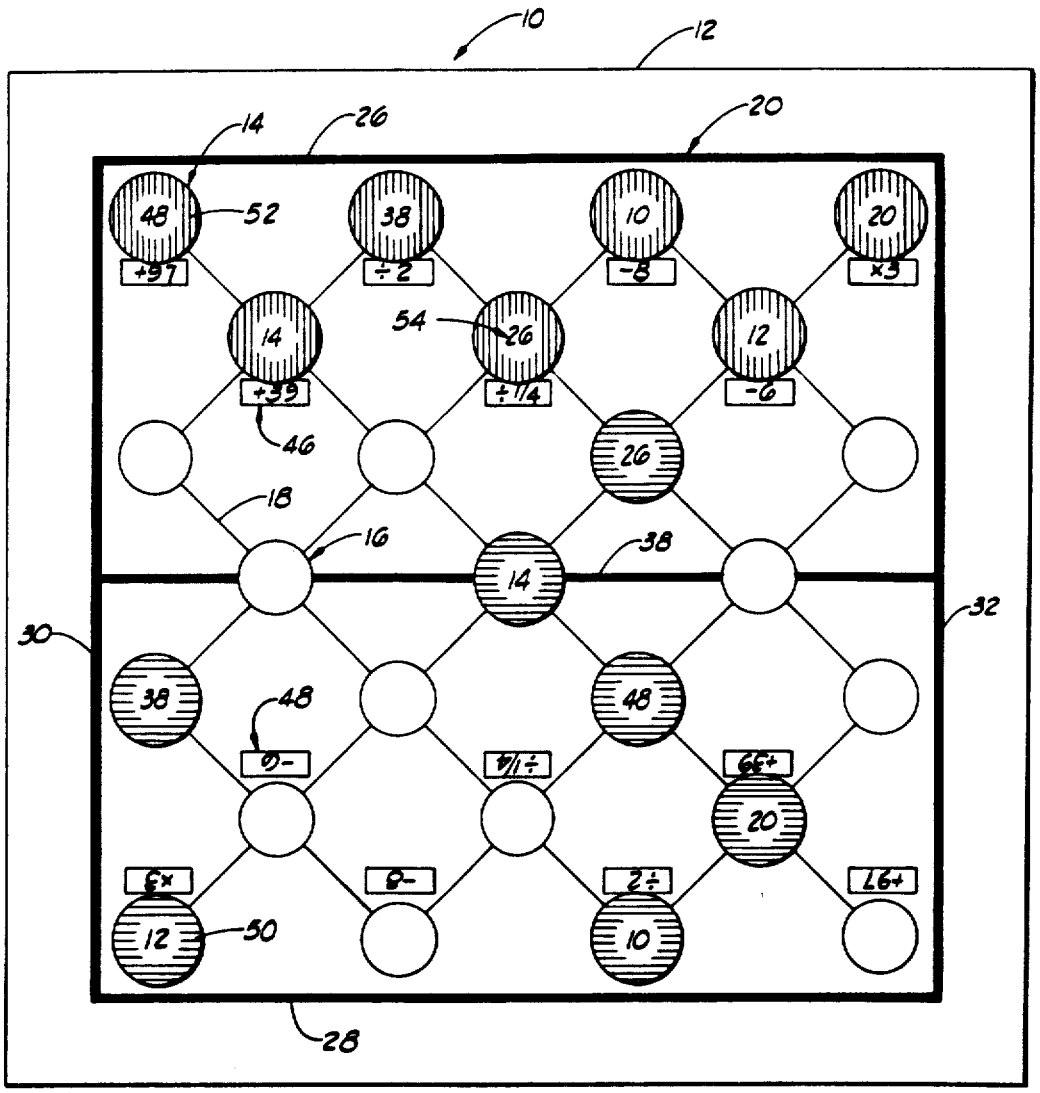
FIG. 3 is a top plan view of the game board of FIGS. 1 and 2 showing the playing pieces in a typical end of game position.

Shown in FIGS. 1, 2 and 3 is a math game 10 constructed in accordance with the present invention. The math game 10 includes a game board 12 and a plurality of playing pieces 14 (the game board 12 being shown in FIG. 1 without the playing pieces 14 disposed thereon).

The game board 12 has a plurality of circularly shaped spaces defined thereon comprising goals 16. As shown in FIGS. 1-3, there are twenty-five goals 16 on the game board 12. Each of the goals 16 is connected to at least one other goal 16 by way of a diagonal lines defining playing paths 18 (only some of the playing paths 18 being designated with a reference numeral in FIGS. 1, 2 and 3). More particularly, some of the goals 16 are connected to two other goals 16 by way of playing paths 18 and some of the goals 16 are connected to four other goals 16 by way of playing paths 18. The goals 16 and the playing paths 18 are disposed within a rectangularly shaped playing space 20 defined on the game board 12.

The game board 12 has four horizontal even rows 22 (the horizontal even rows 22 being individually designated in FIG. 1 by the reference numerals 22*a*, 22*b*, 22*c* and 22*d*). The game board 12 also is divided into horizontal odd rows 24 (three horizontal odd rows 24 being shown in FIG. 1 and designated by the reference numerals 24*a*, 24*b* and 24*c*). Each horizontal odd row 24 is disposed between two of the horizontal even rows 22. The terms "odd" and "even" as used herein with respect to the rows 22 and 24 are merely for identification purposes.

The playing space 20 is defined by a first end 26, a second end 28, a first side 30 and a second side 32. The horizontal even row 22*a* is disposed adjacent the first end 26 and extends generally between the first and the second sides 30 and 32. The horizontal even row 22*d* is disposed adjacent the second end 28 and extends generally between the first and the second sides 30 and 32. The horizontal even rows 22 and the horizontal odd rows 24 each extend between the first and the second sides 30 and 32 of the playing space 20.

By spacing the horizontal even rows 22 and the horizontal odd rows 24 in the manner described before and by arranging the number of goals 16 in each horizontal even row 22 to be more than the number of goals 16 in each horizontal odd row 26, a goal 16 is disposed at each corner of the playing space 20. The playing space 20 is divided into a first playing space 34 (FIG. 1) and an equal second playing space 36 (FIG. 1) with a centerline 38 dividing the playing space 20 into the equal first and second playing spaces 34 and 36. The horizontal odd row 24*b* is disposed on the centerline 38.

There are four goals 16 disposed in each horizontal even row 22 and there are three goals 16 disposed in each horizontal odd row 24. The horizontal even row 22*a* and the horizontal odd row 24*a* comprise first home goals 40. The horizontal even row 22*d* and the horizontal odd row 24*c* comprise second home goals 42. The horizontal even row 22*b*, the horizontal odd row 24*b* and the horizontal even row 22*c* comprise field goals 44 with the field goals 44 being disposed between the first home goals 40 and the second home goals 42.

A first goal math indicia 46 is associated with each of the first home goals 40 (only one indicia 46 being designated with a reference numeral in FIGS. 1, 2 and 3). A second goal math indicia 48 is associated with each of the second home goals 42 (only one indicia 48 being designated with a reference numeral in FIGS. 1, 2 and 3). The first and the second goal math indicia are disposed on the game board 12. Each of the first and the second goal math indicia 46 and 48 comprise a math sign (such as the sign for multiply, add, subtract or divide) and a numeral.

As shown in FIGS. 2 and 3, the playing pieces 14 more particularly comprise a plurality of first playing pieces 50 and a plurality of second playing pieces 52 (only one of the playing pieces 50 and only one of the playing pieces 52 being designated with a reference numeral in FIGS. 2 and 3). As shown in FIGS. 2 and 3, there are seven first playing pieces 50 and seven second playing pieces 52. The first and the second playing pieces 50 and 52 are shown in FIGS. 2 and 3 distinguished by different cross hatching with the first playing pieces having horizontal cross hatching and the second playing pieces having vertical cross hatching with each of the cross hatching depicting a different color or other distinguishing characteristic. The first and the second playing pieces 50 and 52 also could be distinguished by having the first playing pieces of a different shape as compared to the shape of the second playing pieces 52 or any other suitable means for distinguishing the first playing pieces from the second playing pieces.

A playing math indicia 54 is disposed on each of the playing pieces 14 (only one indicia 54 being designated in FIGS. 2 and 3 with a reference numeral). The playing math indicia 54 comprises a numeral.

As mentioned before, the first and the second goal math indicia 46 and 48 each comprise a math sign and a numeral and each playing piece has disposed thereon a playing math indicia comprising a numeral. The math game 10 could be constructed in a manner where each of the first and the second goal math indicia 46 and 48 comprise a numeral and each of the playing math indicia 54 comprise a math sign and a numeral.

The first and the second playing pieces 50 and 52 are disposed on the playing space 20 in the start of game position. In the start of game position, each of the first playing pieces 50 is disposed on one of the first home goals 40 and each of the second playing pieces 52 is disposed on one of the second home goals 42.

As shown in FIGS. 1, 2 and 3, the math game 10 specifically is designed for use with two players. Each player is assigned either the first playing pieces 50 or the second playing pieces 52. After the playing pieces 50 and 52 have been positioned in the start of game position (shown in FIG. 2), each player alternatively moves one of the playing pieces 50 or 52 assigned to that player over the playing paths 18 and onto one or more of the field goals 44 and toward the opposite first or second home goals 40 or 42. In other words, the object of the game is for the player assigned to the first playing pieces 50 to move those first playing pieces 50 in a direction generally toward the second end 28 of the playing space 20 and onto the second home goals 42. By the same token, it is the object for the second player assigned to the second playing pieces 52 to move those second playing pieces 52 toward the first end 26 of the playing space 20 and onto the first home goals 40. In each instance, the player can only move the playing pieces 14 along the diagonal playing paths 18. While moving the playing pieces 50 or 52 generally toward the second home goals 42 or the home goals 40 respectively, the player can jump either the playing pieces 14 assigned to that player or the playing pieces 14 assigned to the opposing player.

Each of the home goals 40 and 42 is associated with one of the goal math indicia 46 or 48. It is the object of the player assigned the first playing pieces 50 to move each of the first playing pieces 50 to the second home goal 42 associated with the second goal math indicia 48 which will yield the highest score for that player. By the same token, it is the object for the player assigned to the second playing pieces 52 to move each of those second playing pieces 52 to one of the first home goals 40 associated with the first goal math indicia 46 which will yield the highest score to that player. The game is finished (end of game) when neither player can move or when one of the players has moved all of his playing pieces 14 to the opposite first or second home goals 40 or 42. The playing pieces 50 and 52 are shown in FIG. 3 in the end of game position wherein the player assigned to the second playing pieces 52 has moved all of those playing pieces 52 to position each of the second playing pieces 52 on one of the first home goals 40.

At the end of game, each player determines that players' score by combining the playing math indicia on the particular playing piece 14 with the appropriate goal math indicia 46 or 48. For example, assuming the playing pieces 50 and 52 are positioned as shown in FIG. 3 at the end of game, the player controlling the second playing pieces 52 would have won the game since all of the second playing pieces 52 are positioned on one of the first home goals 40. This player controlling the second playing pieces 54 would determine this players, score as follows:

| | PLAYING MATH INDICIA | | FIRST GOAL MATH INDICIA | | SCORE |
|---|---|---|---|---|---|
| 1. | 48 | + | 97 | = | 145 |
| 2. | 38 | ÷ | 2 | = | 19 |
| 3. | 10 | − | 8 | = | 2 |
| 4. | 20 | × | 3 | = | 60 |
| 5. | 14 | + | 39 | = | 53 |
| 6. | 26 | ÷ | ½ | = | 104 |
| 7. | 12 | − | 6 | = | 6 |
| | | | | Total Score | 389 |

The player controlling the first playing pieces 52 would determine that players, score as follows:

| | | | | | |
|---|---|---|---|---|---|
| 1. | 10 | ÷ | 2 | = | 5 |
| 2 | 12 | × | 3 | = | 36 |
| 3. | 20 | + | 39 | = | 59 |
| | | | | Total Score | 100 |

In the example just given, there also is a penalty for all playing pieces 50 or 52 still on the original home goal 40 or 42. In other words, for each playing piece 50 remaining on one of the first home goals 40, there would be a penalty equal to the playing piece indicia and goal function times five. This penalty would be deducted from the total players' score.

In addition, there are penalties for each playing piece 50 and 52 remaining on one of the field goals 44 equal to the playing math indicia times a penalty factor. In the example shown in FIG. 3, the player controlling the first playing pieces 50 would have penalties equal to fourteen times ten or one hundred forty plus thirty-eight times two or seventy-six plus forty-eight times two or ninety-six. These penalties also would be deducted from the players score controlling the first playing pieces 50 in the example shown in FIG. 3.

In addition, penalties also can be assessed for any player who calculates the wrong score on his own behalf.

The object of the game is to provide a entertaining way to encourage players to enhance their math and strategy skills.

EMBODIMENT OF FIG. 4

Figure 4:
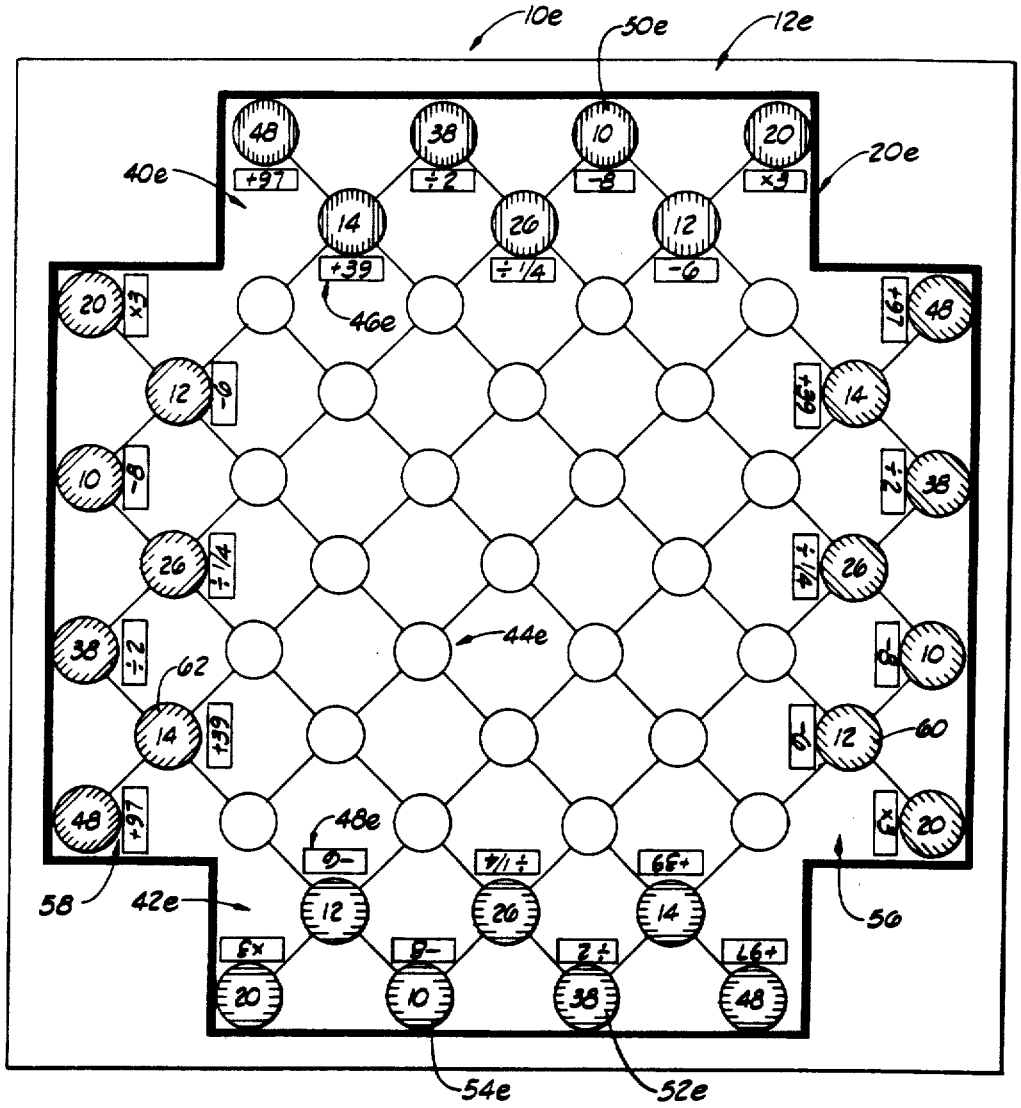
FIG. 4 is a top plan view of a modified game board, showing playing pieces in a start of game position.

Shown in FIG. 4 is a modified math game 10*e* which is constructed exactly like the math game 10 described before, except the math game 10*e* includes a modified game board 12*e* with a modified playing space 20*e*. The math game 10*e* includes a plurality of additional goals defining third home goals 56 and a plurality of additional goals defining fourth home goals 58. The math game 10*e* also includes a plurality of additional field goals 44*e*. The field goals 44*e* are disposed between the first and the second home goals 40*e* and 42*e* and between the third and the fourth home goals 56 and 58. The math game 10*a* also includes a plurality of third playing pieces 60 with each of the third playing pieces 60 being indicated with a diagonal type of cross hatching in FIG. 4 and each of the third playing pieces 60 being disposed on one of the third home goals 56 in the start of game position. The math game 10*a* also includes a plurality of fourth playing pieces 62 with each of the fourth playing pieces 62 being designated with diagonal cross hatching in FIG. 4 and each of the fourth playing pieces 62 being disposed on one of the fourth home goals 58 in the start of game position shown in FIG. 4 (only one of the third playing pieces 60 and only one of the fourth playing pieces 62 are designated with reference numerals in FIG. 4).

The math game 10*e* shown in FIG. 4 is played basically the same as the math game 10 shown in FIGS. 1, 2 and 3 described in detail before, except the math game 10*e* accommodates two additional players. In this instance, a third player would control the third playing pieces 60 starting on the third home goals 56 and the fourth player would control the fourth playing pieces 62 starting on the fourth home goals 58. Any one of the players can move the playing pieces controlled by that player to any one of the other three home goals during the play of the game. The object being that the player should attempt to move that players' playing pieces to a home goal most advantageous to the player. For example, the player controlling the first playing pieces 50*e* can move any one of his first playing pieces 50*e* to any one of the second home goals 42*e* or third home goals 56 or fourth home goals 58. By the same token, the player controlling the second playing pieces 52*e* can move any one of his second playing pieces 52*e* to any one of the first home goals 40*e*, the third home goals 56 or the fourth home goals 58. The player controlling the third playing pieces 60 can move any one of his third playing pieces 60 to any one of the first home goals 40*e*, second home goals 42*e* or fourth home goals 58. The player controlling the fourth playing pieces 62 can move any one of his fourth playing pieces 62 to any one of the first home goals 40*e*, the second home goals 42*e* or the third home goals 56.

EMBODIMENT OF FIGS. 5, 6 AND 7

Figure 5:
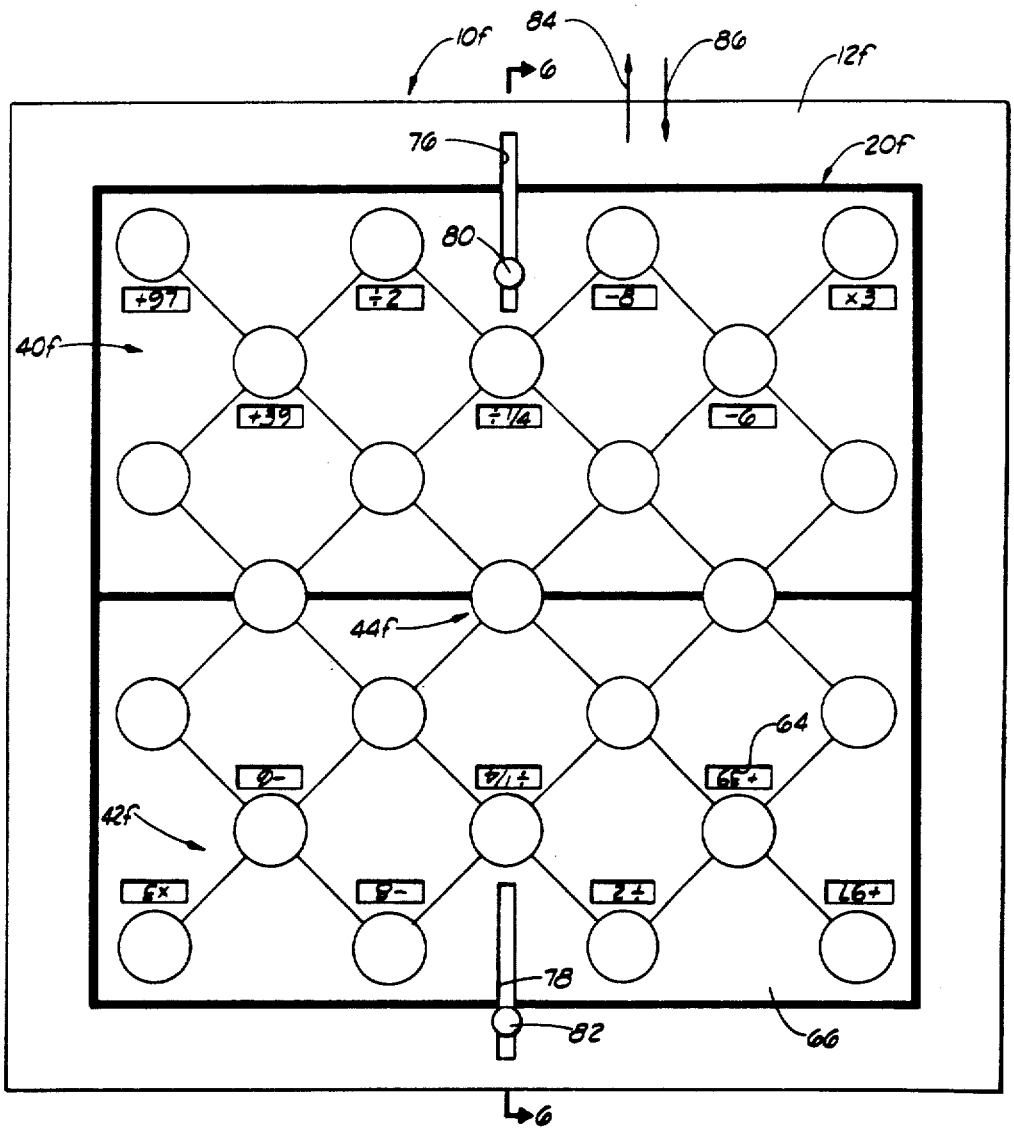
FIG. 5 is a top plan view of another modified game board with the playing pieces removed therefrom.
Figure 6:
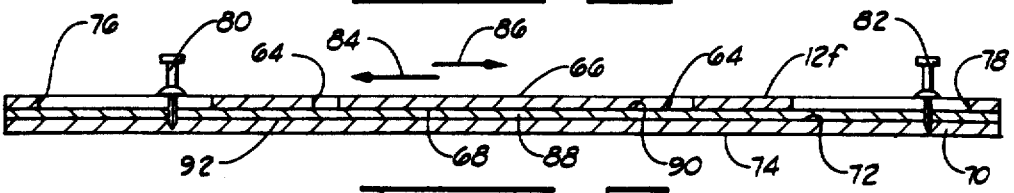
FIG. 6 is a sectional view taken generally along the lines 6—6 of FIG. 5.

Shown in FIGS. 5 and 6 is a math game 10*f* which includes a game board 12*f* constructed exactly like the game board 12 described in detail before, except the game board 12*f* includes a plurality of slots 64 (only one of the slots 64 being designated with the reference numeral in FIG. 5). Each of the slots 64 intersects an upper surface 66 and a lower surface 68 of the game board 10*f*. Each of the slots 64 is disposed in exactly the same position as one of the first or second math goal indicia 46 or 48 as described before in connection with the game board 12 shown in FIGS. 1, 2 and 3.

The math game 10*f* includes a game box 70 comprising a flat board as shown more clearly in FIG. 6. The game box 70 includes an upper surface 72 and a lower surface 74. The game board 12*f* is disposed on the upper surface 72 of the game box 70.

A first slot 76 is disposed through the game board 12*f* intersecting the upper and the lower surfaces 66 and 68 thereof. The first slot 76 extends a distance generally between the first and second ends of the playing space 20*f* and is disposed generally at the first end and generally between the first and the second sides.

The game board 12*f* also includes a second slot 78. The second slot 78 is disposed through the game board 12*f* intersecting the upper and the lower surfaces 66 and 68 thereof. The second slot extends a distance between the first and the second ends of the playing space 20*f* and is disposed generally near the second end and generally between the first and the second sides.

A retaining pin 80 extends through the first slot 76 and extends through a portion of the game box 70. A retaining pin 82 is disposed in the second slot 78 and extends into a portion of the game box 70. The game board 12*f* thus is slidingly disposed on the game box 70 so that the game board 12*f* may be slid in a first direction 84 or a second direction 86 with the game board 12*f* being slidingly disposed about the retaining pins 80 and 82. Each of the retaining pins 80 and 82 includes a head on one end thereof for preventing the game board 12*f* from being lifted in a generally upwardly direction and removed from the game box 70.

The math game 10*f* also includes a math function board 88 (FIGS. 6 and 7) which is disposed on the upper surface 72 of the game box 70 and interposed generally between the game board 12*f* and the game box 70.

Figure 7:
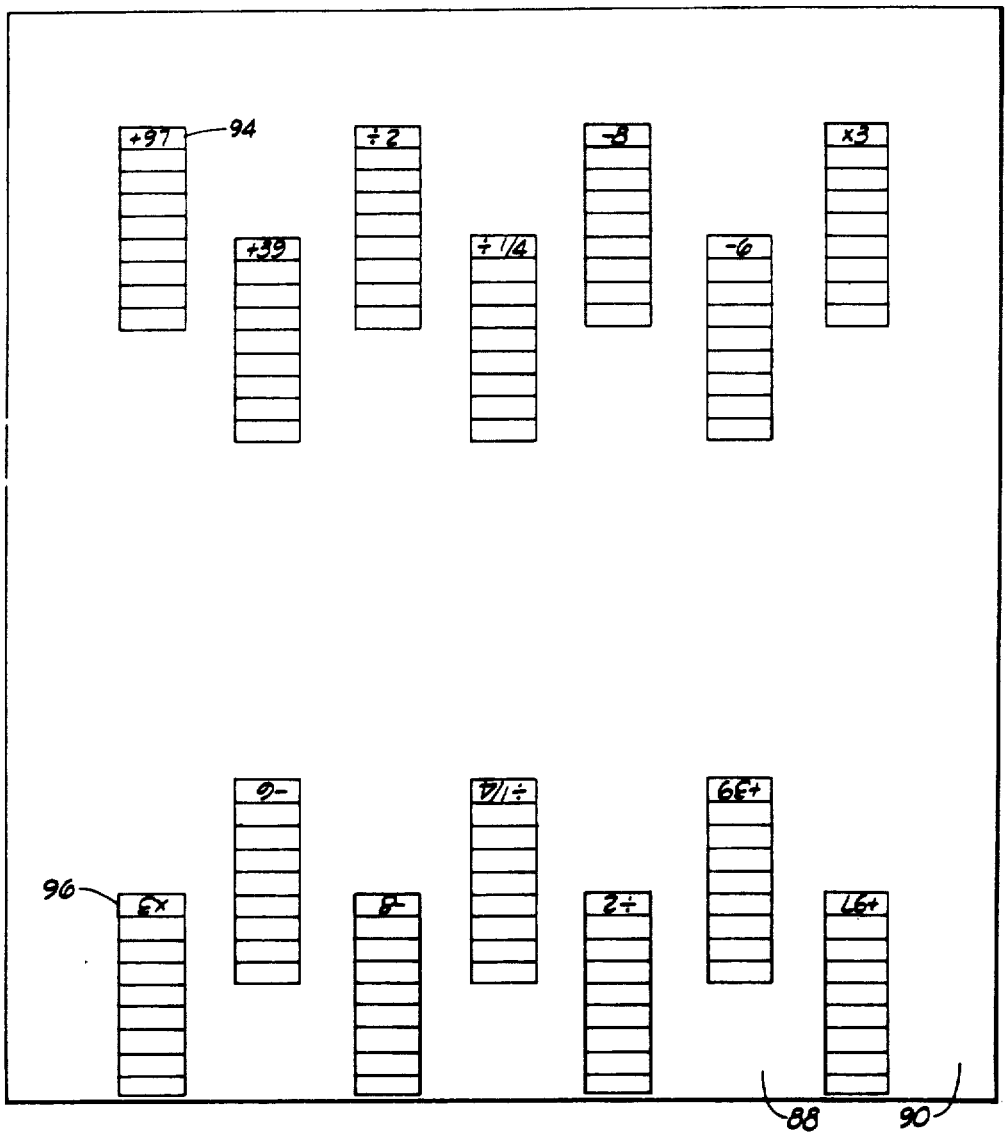
FIG. 7 is a top plan view of a math function board used with the game board shown in FIGS. 5 and 6.

The math function board 88 is shown more clearly in FIG. 7. The math function board 88 includes an upper surface 90 and a lower surface 92 (FIG. 6). The math function board 88 is interposed between the game board 12*f* and the game box 70 with the lower surface 92 of the math function board 88 being disposed adjacent the upper surface 72 of the game box 70. The retaining pins 80 and 82 each are secured through the math function board 88 and the game box 70 so that the math function board 88 and the game box 70 are connected by way of the retaining pins 80 and 82.

The math function board 88 has modified first math goal indicia and modified, second math goal indicia disposed on the upper surface 90 thereof. Each of the first goal math indicia includes a plurality of different math indicia 94 as shown in FIG. 7 (only one of the different math indicia 94 associated with one of the first goal math indicia being designated with the reference numeral in FIG. 7).

The math function board 88 also includes modified second goal math indicia. Each of the modified second goal math indicia includes a plurality of different math indicia 96 (only one of the different math indicia 96 associated with one of the second goal math indicia 48*a* being designated with a reference numeral in FIG. 7).

Each of the first goal math indicia is alignable with one of the slots 64 associated with one of the first home goals 40*f*. Each of the different math indicia 96 is alignable with one of the slots 64 associated with one of the second home goals 46*f*.

In operation, the players initially move the game board 12*f* in the first or second direction 84 or 86 to a position wherein one of the math indicia 94 is aligned with each of the slots 64 associated with the first home goals 40*f* and one of the math indicia 96 is aligned with each of the slots 64 associated with the second home goals 42*f*, the different math indicia 94 and 96 being visible via the slots 64 in the game board 12*f*. Utilizing the modified math game 10*f* with the math function board 88, the players can change the first and second goal math indicia by moving the game board 12*f* to position different math indicia near each of the first and second home goals 40*f* and 42*f*. It should be noted that, in lieu of moving the game board 12*f*, the math game 10*f* could be constructed so that the math function board 88 is movable to align different math indicia 94 and 96 with the slots 64.

EMBODIMENTS OF FIGS. 8, 9 AND 10

Figure 8:
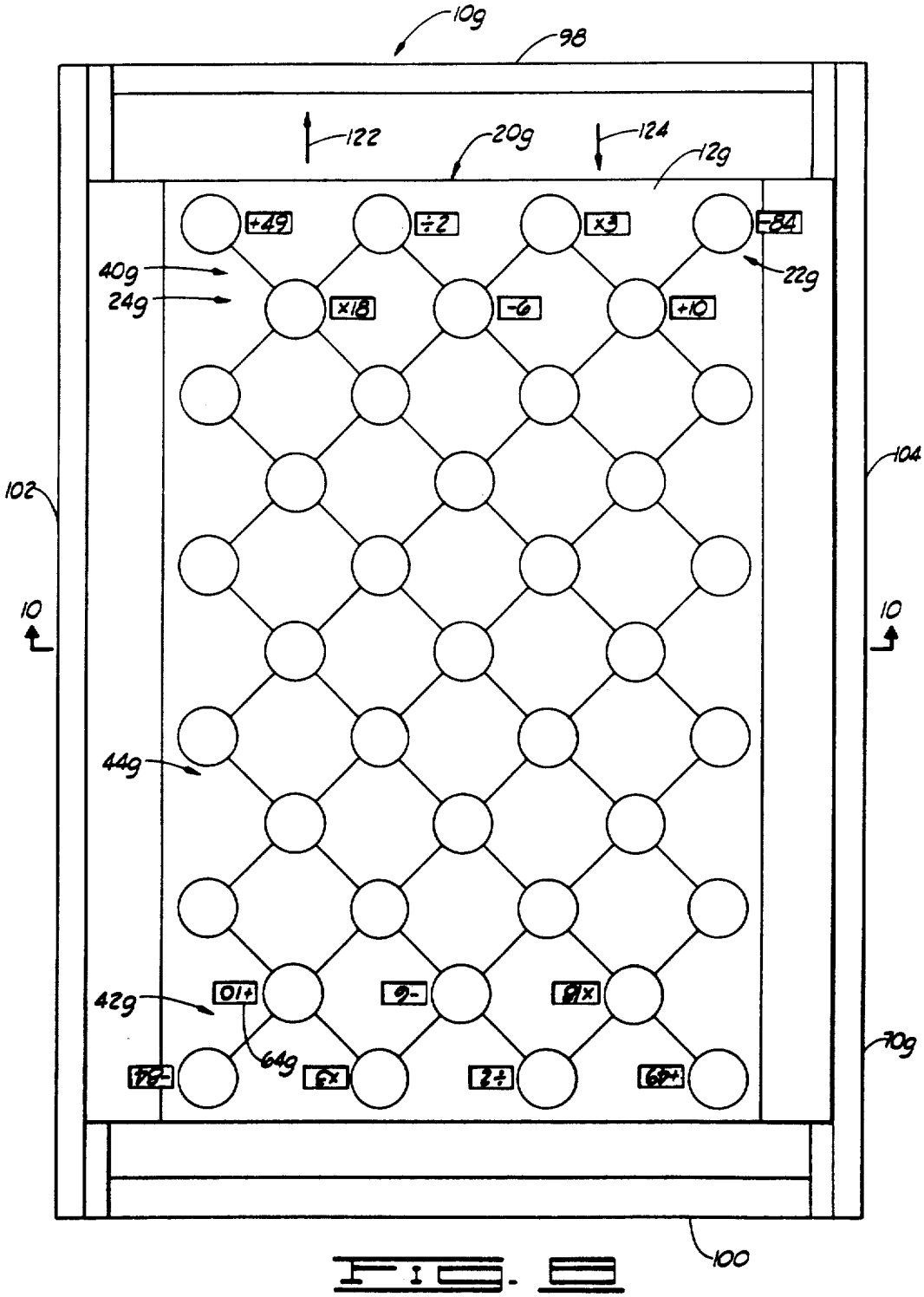
FIG. 8 is a top plan view of another modified game board shown supported in a game box.
Figure 9:
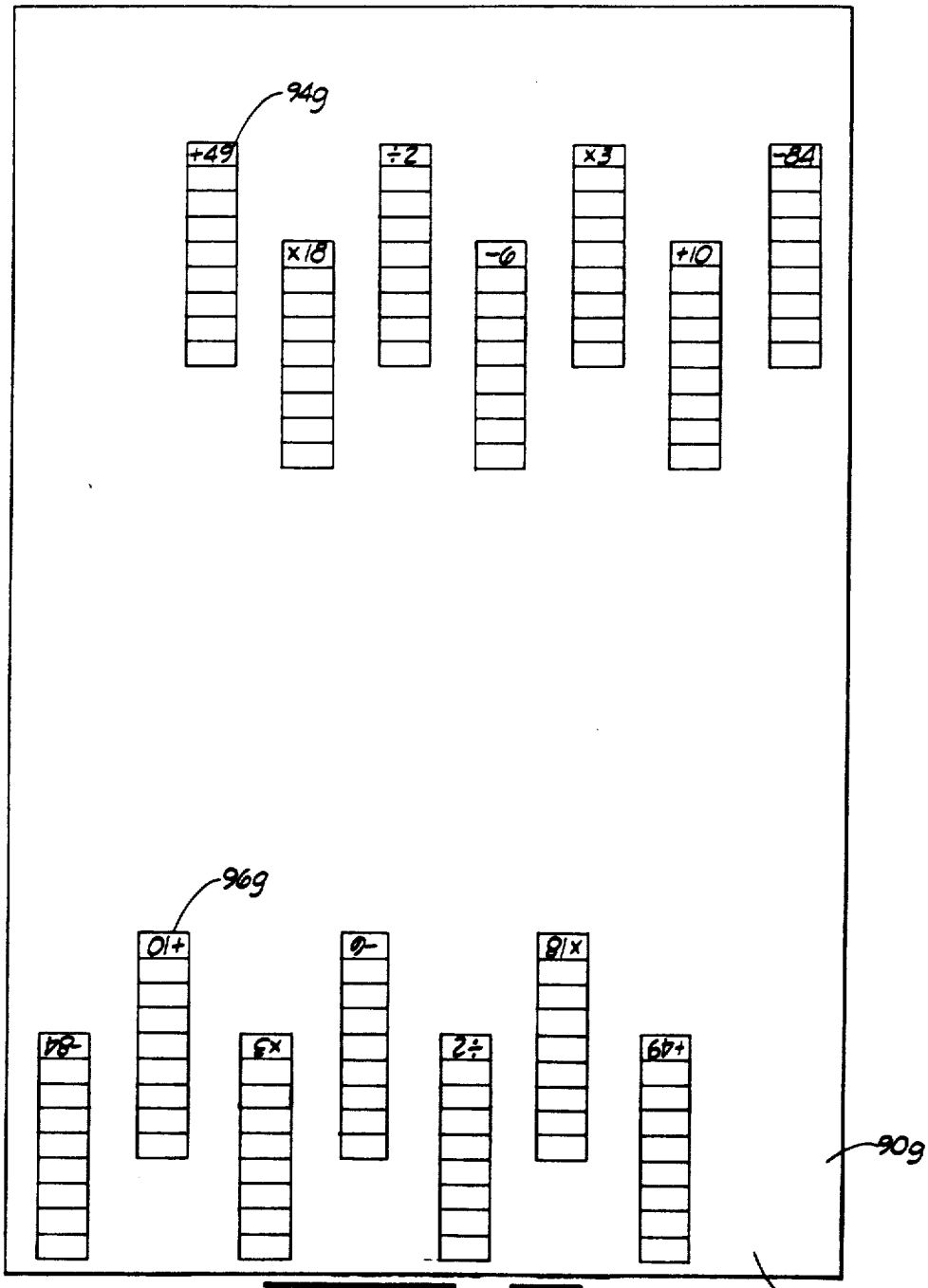
FIG. 9 is a top plan view of a math function board used with the game board and game box shown in FIG. 8.
Figure 10:
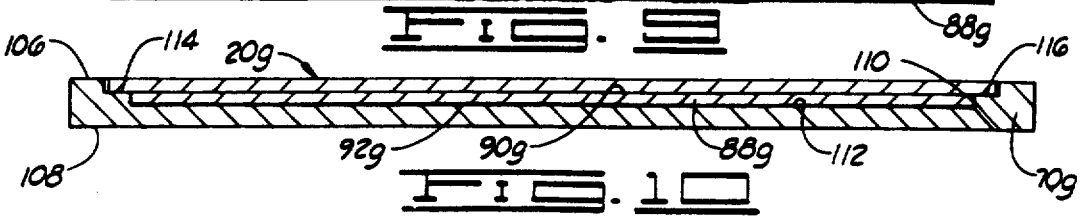
FIG. 10 is a sectional view taken substantially along the lines 10—10 of FIG. 8.

The embodiments of FIGS. 8, 9 and 10 is a modified math game 10*g* having a modified game board 12*g* secured to a modified game box 70*g*. The modified game box 70*g* includes a first end 98, a second end 100, a first side 102 and a second side 104. The modified game box 70*g* also includes an upper surface 106 and a lower surface 108.

A recess 110 (FIG. 10) is formed through the upper surface 106 of the game box 70*g*. The recess 110 extends a distance through the game box 70*g* terminating with a lower surface 112 (FIG. 10). A counter recess is formed in the upper surface 106 of the game box 70*g* forming a first ledge 114 (FIG. 10) extending generally along the first side 102 and a second ledge 116 extending generally along the second side 104 of the game box 70*g*. The game board 12*g* is disposed on the first and the second ledges 114 and 116 and secured to the game box 70*g* in this position.

The modified math game 10*g* includes a modified math function board 88*g* (FIGS. 9 and 10) having modified math indicia 94*g* and modified math indicia 96*g* disposed on the upper surface 90*g* thereof.

The modified game board 12*g* is constructed exactly like the game board 12*f* and includes a plurality of slots 64*g* formed therethrough and positioned near the first and second home goals 40*g* and 42*g*, except the game board 12*g* includes six horizontal even rows 22*g* and five horizontal odd rows 24*g* instead of the four horizontal even rows 22*f* and the three horizontal odd rows 24*f* of the game board 12*f* shown in FIG. 5.

The math function board 88*g* is slidingly disposed on the lower surface 112 formed by the recess 110 so that the math function board 88*g* is movable in a first direction 122 (FIG. 8) and a second direction 124 (FIG. 8). As shown in FIG. 8, the math function board 88*g* has been moved to a position wherein certain of the math indicia 94*g* and 96*g* are aligned with certain of the slots 64*g* in the game board 12*g*. To change the math indicia 94*g* and 96*g*, the players move the math function board 88*g* in the first direction 122 or the second direction 124.

EMBODIMENTS OF FIGS. 11 AND 12

Figure 11:
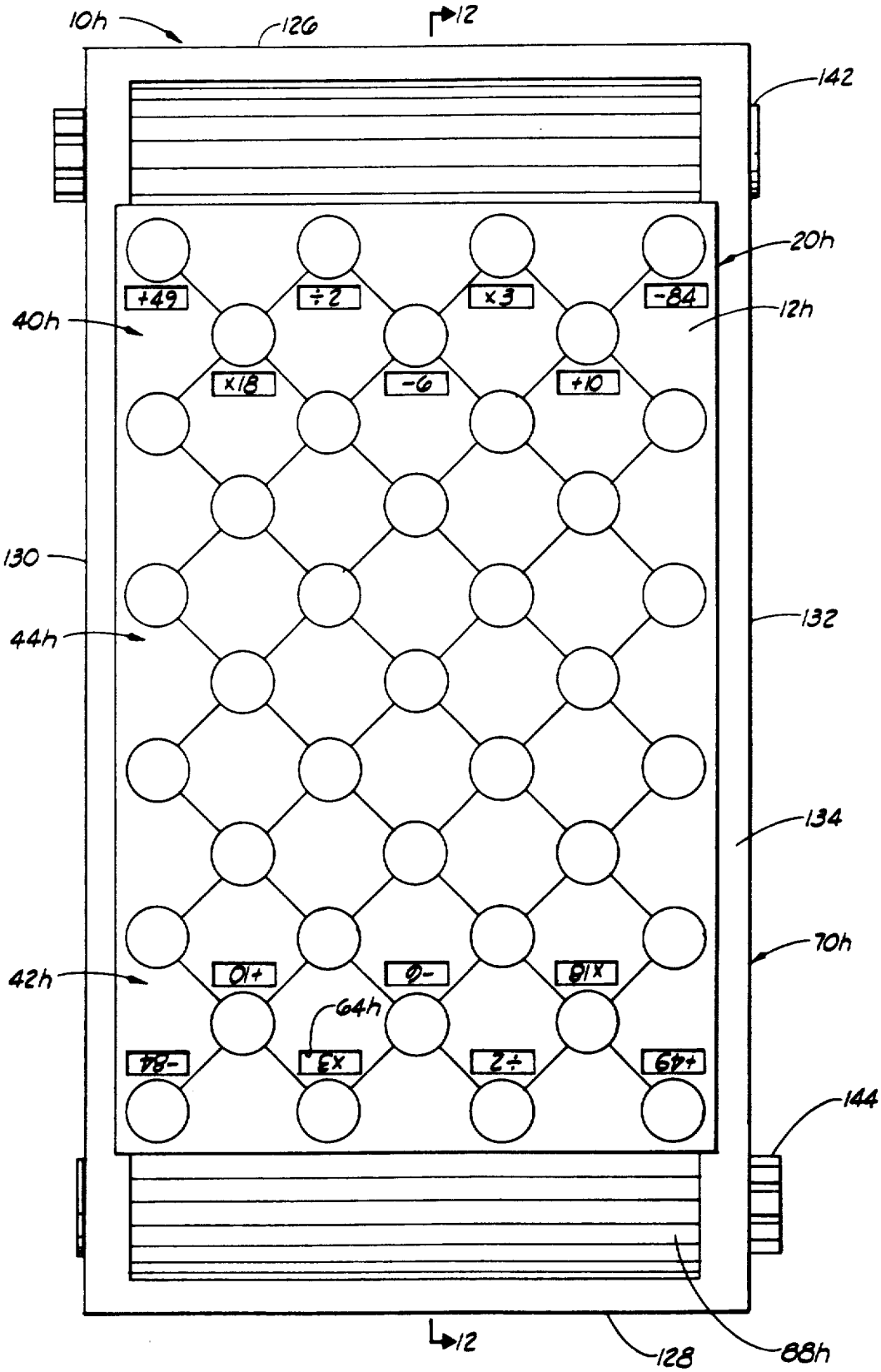
FIG. 11 is a top plan view of a game board constructed like the game board shown in FIG. 8 shown supported in a modified game box.
Figure 12:
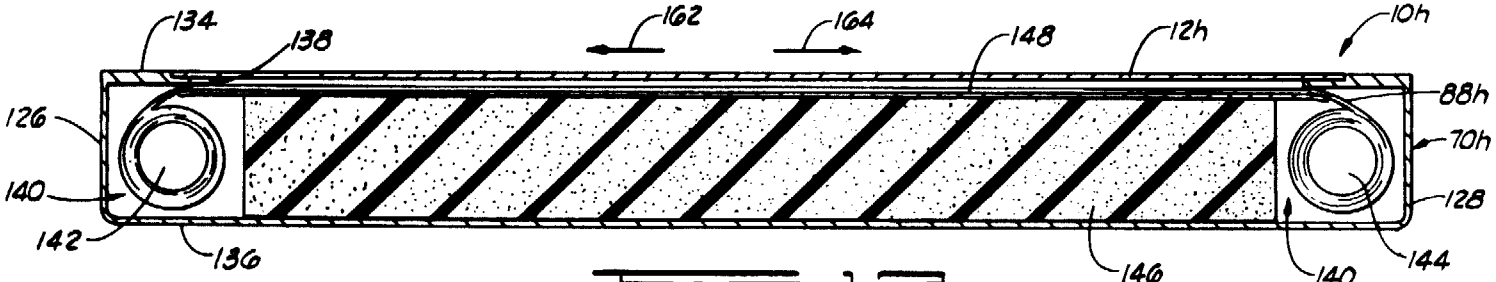
FIG. 12 is a sectional view of the modified math game of FIG. 11, taken substantially along the lines 12—12 of FIG. 11.

Shown in FIGS. 11 and 12 is a modified math game 10*h* having a modified game board 12*h* supported on modified game box 70*h*. The game board 12*h* is constructed exactly like the game board 12*g* shown in FIG. 8 and described before.

As shown in FIG. 12, the game box 70*h* has a first end 126, a second end 128, a first side 130 and a second side 132. The game box 70*h* also includes an upper surface 134 and a lower surface 136. An opening 138 is formed through the upper surface 134 and extends a distance through the game box 70*h* toward the lower surface 136 forming a component space 140.

The game board 12*h* is supported on the upper surface 134 of the game box 70*h*. The game board 12*h* is secured in this position to the game box 70*h*. A first roller 142 is disposed near the first end 126 of the game box 70*h*. The first roller 142 extends through the first and the second sides 130 and 132 with a portion of the first roller 142 being disposed in the component space 140. A second roller 144 is rollingly connected to the game box 70*h* near the second end 128. The second roller 144 extends through the first and the second sides 130 and 132. A portion of the second roller 144 is disposed in the component space 140. The first and the second rollers 142 and 144 each are rollingly supported on the game box 70*h*.

The math game 10*h* includes a modified math function board 88*h* (FIG. 12) which is constructed exactly like the math function board 88 shown in FIG. 7 and described in detail before, except the math function board 88*h* is constructed of a flexible material such as paper and one end of the math function board 88*h* is connected to the first roller 142 and the opposite end of the math function board 88*h* is connected to the second roller 146. The math function board 88*h* thus is supported in the component space 140 and the portion of the math function board 88*h* extends generally between the first and the second rollers 142 and 144.

A board support 146 (FIG. 12) is disposed in the component space 140 and supported on the game box 70*h*. The math function board 88*h* is movably disposed on an upper surface 148 of the board support 146.

The math game 10*h* will operate similar to the math game 10*g* described before, except when the players desire to change the math indicia 94 and 96, the players rotate the first roller 142 or rotate the second roller 144 thereby moving the math function board 88*h* in directions 162 (FIG. 12) or 164 (FIG. 12) to change the math indicia associated with the first and second home goals 40*h* and 42*h*. Since the math function board 88*h* is supported on the rollers 142 and 144, it is possible to practically extend the length of the math function board 88*h* as compared to the length of the math function board 88 thereby permitting more or additional math indicia to be included on the math function board 88*h* as compared to the number of math indicia included on the math function board 88.

In this embodiment, there could be a belt extending between the rollers 142 and 144 so that the rollers 142 and 144 would roll simultaneously when either the roller 142 or 144 is rolled by one of the players.

EMBODIMENT OF FIG. 13

Figure 13:
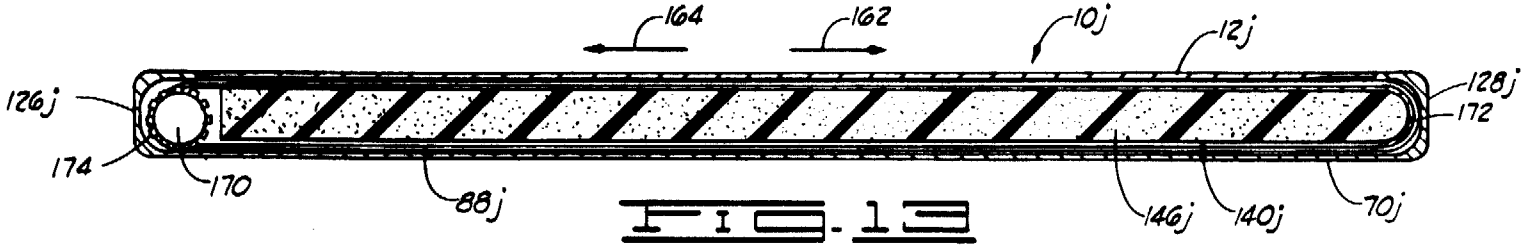
FIG. 13 is a sectional view, similar to FIG. 12, but showing a modified game box and a modified math function board.

Shown in FIG. 13 is a modified math game 10*j* having a modified game box 70*j*. A game board 12*j* is connected to the game box 70*j*. The game board 12*j* is constructed exactly like the game board 12*h* shown in FIGS. 11 and 12 and described in detail before. The game box 70*j* is constructed similar to the game box 70*h* shown in FIGS. 11 and 12 and described in detail before, except the game box 70*j* includes only a single roller 170 disposed in the component space 140*j* and rollingly supported in the game box 70*j* in a manner like that described before with respect to the rollers 142 and 144. The single roller 170 is disposed near the first end 126*j* of the game box 70*j*.

The modified board support 146*j* is disposed in the component space 140*j*. The board support 146*j* is constructed like the board support 146 described before, except the board support 146*j* includes a rounded end 172, opposite the end disposed near the roller 170.

The roller 170 has a plurality of teeth 174 spaced about the outer peripheral surface of the roller 170.

The math game 10*j* also includes a modified math function board 88*j* which is constructed like the math function board 88*h* described before, except the math function board 88*j* is a continuous strip of material with the continuous strip extending about the roller across the upper surface of the board support 146*j*, about the rounded end 172 and across the lower surface of the board support 146*j*.

The math game 10*j* will operate in a manner exactly like the math game 10*h* described before, except, with the continuous roll math function board 88*j*, only a single roller needs to be turned in order to change the math indicia associated with the first and second home goals.

In lieu of the curved surface 172, it may be desirable in some applications to include an idle roller.

EMBODIMENT OF FIG. 14

Figure 14:
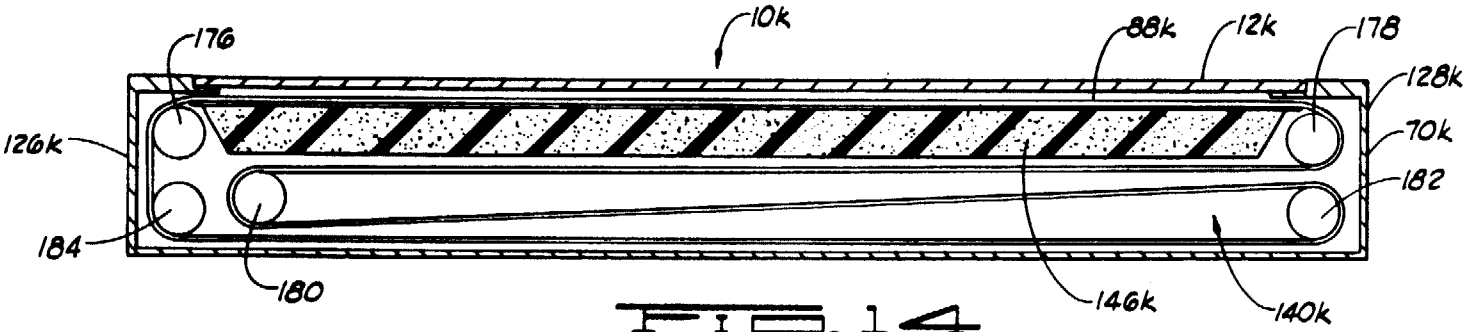
FIG. 14 is a sectional view, similar to FIG. 12, but showing a modified game box and a modified math function board.

Shown in FIG. 14 is a modified math game 10*k* having a modified game box 70*k*. The game box 70*k* is constructed exactly like the game box 70*h* described in detail before, except the component space 140*k* is slightly larger than the component space 140.

In this embodiment, five rollers 176, 178, 180, 182 and 184 are disposed in the component space 140*k*. The rollers 176, 178, 180, 182 and 184 are rollingly supported in the game box 70*k*.

The math function board 88*k* is constructed like the math function board 88*j* described before, except the math function board 88*k* is longer than the math function board 88*j* and includes more or additional math indicia.

The math function board 88*k* extends from the roller 176 across the upper surface of the board support 146*k* about the roller 178, back over the lower surface of the board support 146*k*, about the roller 180, from the roller 180 to and about the roller 182, from the roller 182 to and about the roller 184 and from the roller 184 to and about the roller 176. In this embodiment, the math function board 88*k* may be made longer and can include more math indicia which may be desirable in some applications.

In this embodiment, it may be desirable to add a sprocket to at least one of the rollers and the math function board 88*k* would include holes for being drivingly disposed about the teeth of the sprocket. Also, it may be desirable to spring load at least one of the rollers to keep the math function board 88*k* in tension during the operation of the math game 10*k* in some applications.

EMBODIMENT OF FIG. 15

Figure 15:
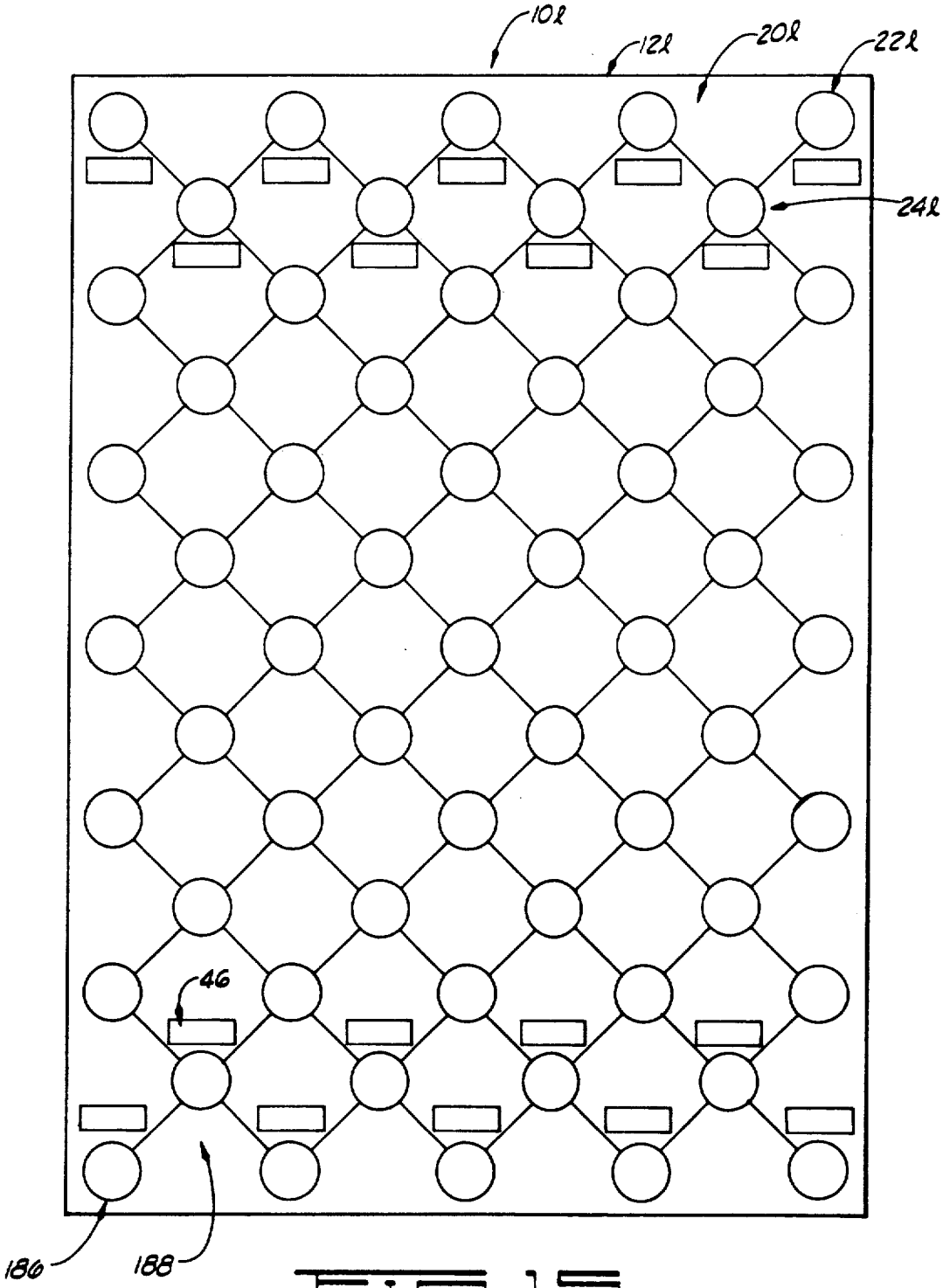
FIG. 15 is a plan view of another modified game board with the playing pieces removed therefrom.

Shown in FIG. 15 is a modified math game 10 which includes a modified game board 12. The game board 12 is constructed like the game board 12*g* shown in FIG. 8, except the game board 12 includes seven horizontal even rows 22 and six horizontal odd rows 24. In this embodiment, one horizontal even row 22 and one horizontal odd row 24 comprise the first home goals and one horizontal even roll 221 and one horizontal odd row 24 comprise the second home goal while the remaining goals comprise the field goals.

EMBODIMENT OF FIG. 16

Figure 16:
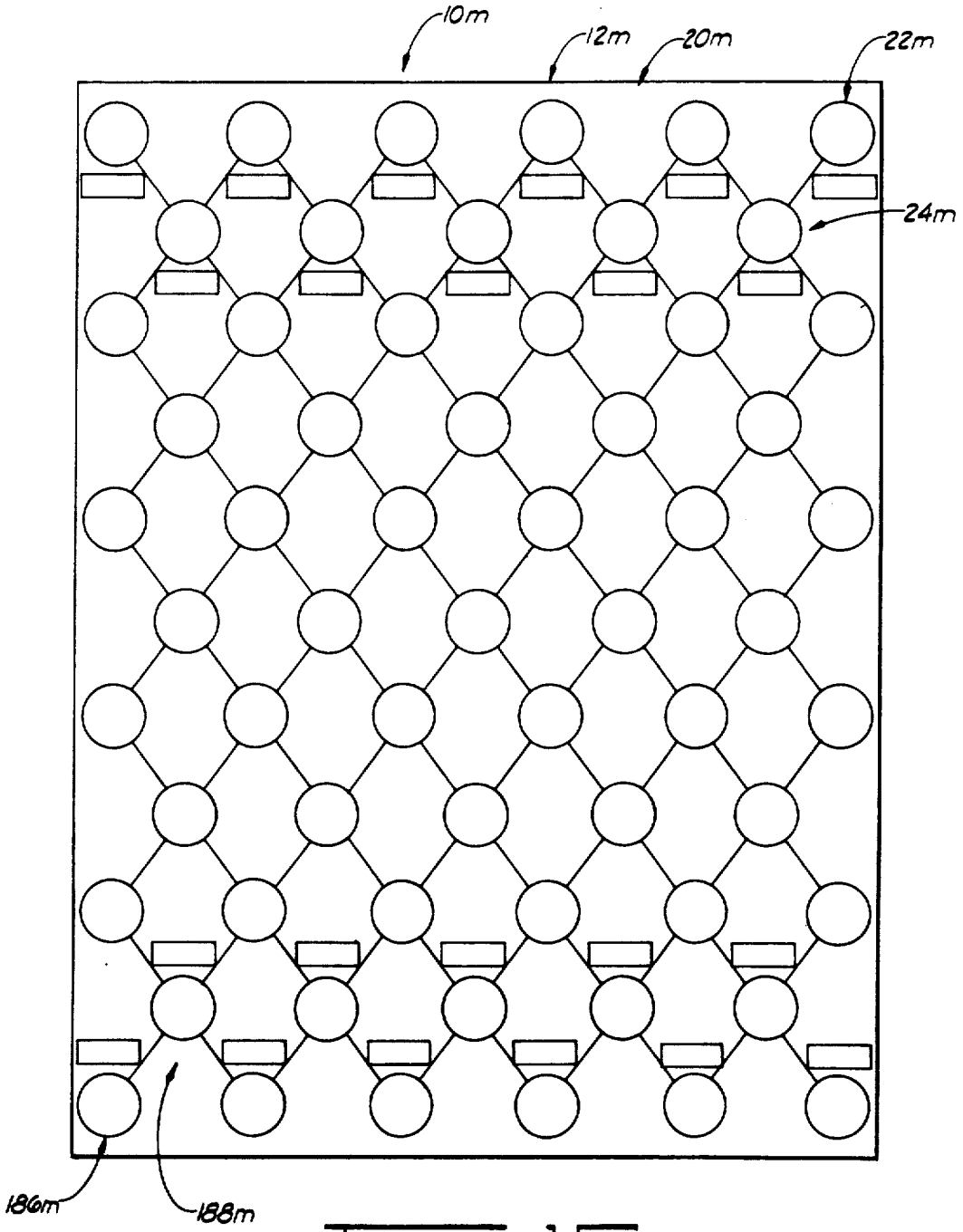
FIG. 16 is a top plan view of yet another modified game board with the playing pieces removed therefrom.

Shown in FIG. 16 is a modified math game 10*m* which is constructed exactly like the math game 10 shown in FIG. 15 except the game board 12*m* includes six horizontal even rows 22*m* and five horizontal odd rows 24*m*. In addition, the game board 12*m* includes six vertical even rows 186*m* and five vertical odd rows 188*m*. As before, one of the horizontal even rows 22*m* and one of the horizontal odd rows 24*m* comprise the first home goals and one of the horizontal even rows 22*m* and one of the horizontal odd rows 24*m* comprise the second home goals 42. The remaining horizontal odd and even rows 22*m* and 24*m* comprise the field goals.

EMBODIMENT OF FIG. 17

Figure 17:
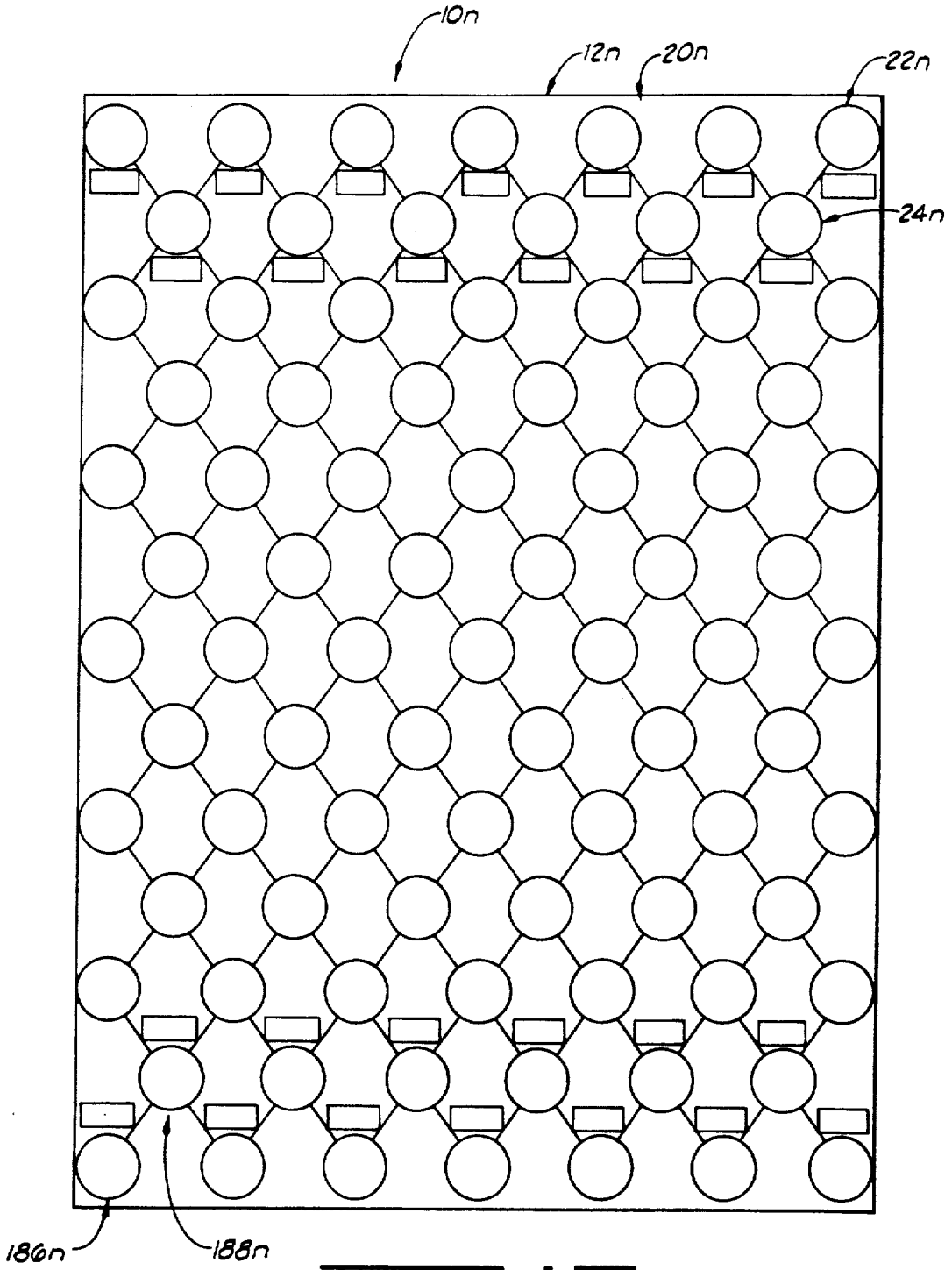
FIG. 17 is a top plan view of still another modified game board with the playing pieces removed therefrom.

Shown in FIG. 17 is another modified game board 10*n* which is constructed exactly like the game boards shown in FIGS. 15 and 16, except the game board 12*n* includes seven horizontal even rows 22*n* and six horizontal odd rows 24*n*. The game board 12*n* includes seven vertical even rows 186*n* and six vertical odd rows 188*n*.

It should be noted that the game boards described herein are constructed of a metallic material in some applications. In these instances, the playing pieces can incorporate a magnet so that the playing pieces are magnetically attached to the game board to substantially prevent sliding movement of the pieces when the game board is moved.

It also should be noted that the game boards described herein are particularly designed so that a playing piece is disposed at each of the four corners of the playing board at the start of the game position. Game boards can be designed which would not incorporate this feature.

It should be noted that the math games having the movable math function board or the movable game board as described herein also could include a game set number which is displayable through a separate opening in the game board which would identify the number of the game being played by the players so that the players would not inadvertently replay the same game having the same math indicia displayed through the openings in the game board. The different game set numbers would be included on the math function board and displayable in a manner similar to that described before with respect to the math indicia.

It also should be noted that the first playing pieces could be movable from the first home goals through the field goals and onto one of the second home goals and then movable back to one or more of the field goals. In this instance, the player might receive a bonus for initially landing the first playing piece on one of the second home goals, but the player still would be permitted to move that playing piece onto one or more of the field goals for perhaps blocking the second players moves or for jumping or capturing some of the second players playing pieces. In this embodiment, the second playing pieces would be movable in a similar fashion.

The first playing pieces also can be permitted to jump the second playing pieces and capture the second playing pieces so jumped thereby removing such jumped second playing pieces from the game. The second playing pieces in this embodiment also would be permitted to jump the first playing pieces and remove such jumped first playing pieces from the game.

As mentioned before, a magnet could be incorporated in the playing pieces for magnetically attaching the playing pieces to a metallic game board. By the same token, holes could be inserted in the game board and the playing pieces could include a tip which is insertable into the holes in the playing board for substantially preventing the sliding movement of the playing pieces when the game board is moved.

The math indicia and the playing math indicia could include various metric measurements. In this embodiment, the math game would not only be helpful in improving math skills, but also the math game would be helpful in improving metric skills of the players.

EMBODIMENT OF FIG. 18

Figure 18:
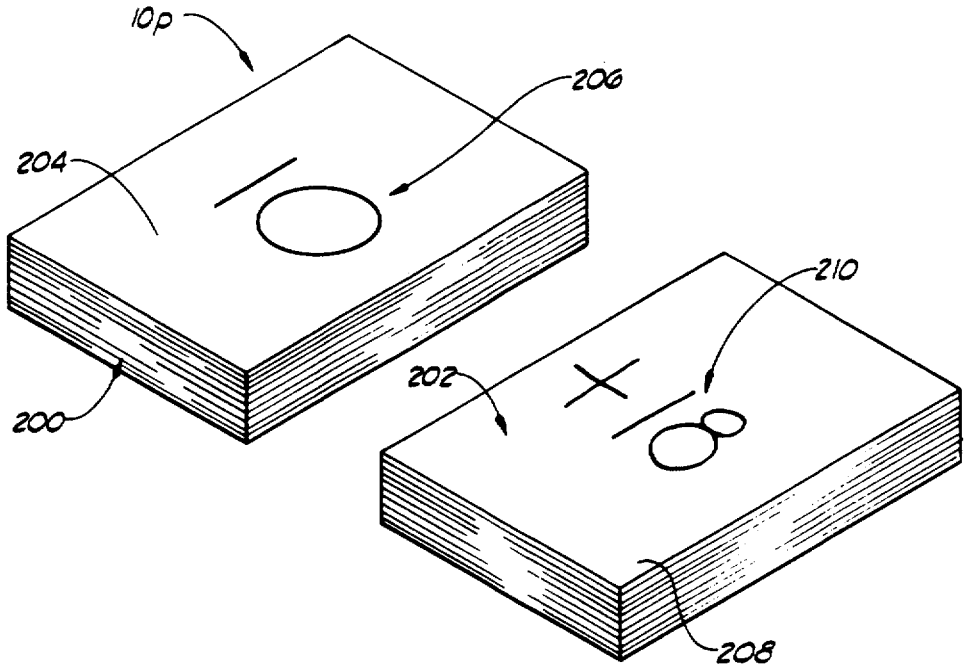
FIG. 18 is a perspective view of a modified math game comprising two decks of playing cards.

Shown in FIG. 18 is a modified math game 10*p*. The math game 10*p* comprises a first deck of playing cards 200 and a second deck of playing cards 202.

The first deck of playing cards 200 comprises a number of individual cards with one of the cards 204 being shown on the top of the first deck of playing cards 200. Each playing card 204 has a math indicia or more particularly a numeral 206 disposed thereon. As shown in FIG. 18, the playing card 204 on the top of the first deck playing cards 200 has the numeral 10 for example printed thereon.

The second deck of playing cards 202 comprises a number of individual playing cards 208. One of the individual playing cards 208 is disposed on the top of the first deck of playing cards 202 as shown in FIG. 18. Each second playing card 208 in the second deck of playing cards 202 has a math indicia 210 disposed thereon. For example, the second playing card 208 disposed on the top of the second deck of playing cards 202 has the math indicia 210 disposed thereon comprising a multiply sign and the numeral eighteen.

In playing the math game 10*p*, each player is dealt five first playing cards 204 and five second playing cards 208. Each player then has the option of returning or discarding one to four of the first playing cards 204 dealt to that player and one to four of the second playing cards 208 dealt to that player. The returned or discarded cards 204 and 208 are replaced by dealing replacement first playing cards 204 and replacement second playing cards 208 to that player. After the replacement cards 204 and 208 have been dealt to the players, each player determines that players score by combining each of the first playing cards 204 with one of the second playing cards 208 with the score being the math indicia of the first playing cards 200 combined with the math function 210 on one of the second playing cards 202 selected or paired by the player.

EMBODIMENT OF FIGS. 19 AND 20

Figure 19:
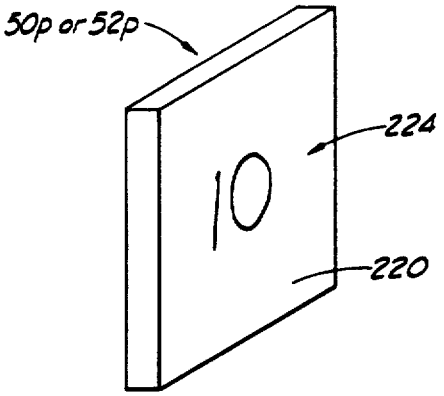
FIG. 19 is a perspective view of a modified playing piece showing the front side of the playing piece.
Figure 20:
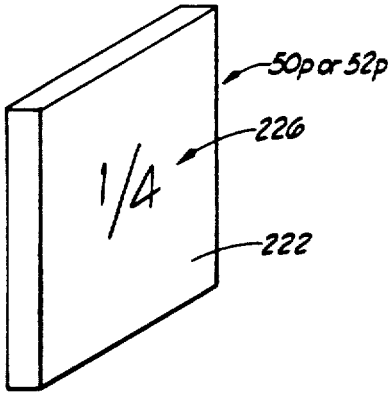
FIG. 20 is a perspective view of the playing piece of FIG. 19 showing the back side of the playing piece of FIG. 19.

Shown in FIGS. 19 and 20 is a typical modified first or second playing piece 50*p* or 52*p*. The modified playing piece 50*p* or 52*p* includes a front side 220 and a back side 222. A first playing math indicia 224 is disposed on the front side of the playing piece 50*p* or 52*p*. A second playing math indicia 226 is disposed on the back side 222 of the playing piece 50*p* or 52*p*.

A math game would be constructed like any of the other math games described before, except the math game shown in FIG. 18, and each of the math games would include a plurality of first and second playing pieces constructed like the playing pieces 50*p* and 52*p* shown in FIGS. 19 and 20. When the playing pieces 50*p* and 52*p* are disposed on the game board with the back sides 222 being disposed adjacent the game board and the front side 220 being displayed to the players, the first math indicia 224 is utilized in playing the game. By the same token, when the playing pieces 50*p* and 52*p* are disposed on the game board with the front side 220 being disposed adjacent the game board, the second playing math indicia 226 are utilized by the players in playing the math game. When utilizing modified playing pieces constructed like the playing piece 50*p* or 52*p* shown in FIGS. 19 and 20, a different math game is presented to each of the players by simply turning the playing pieces 50*p* and 52*p* over displaying one of the other first or second math indicia 224 or 226.

The playing pieces 50*p* or 52*p* shown in FIGS. 19 and 20 would have the front side 220 colored one color and the back side 222 colored another or different color. In this manner, the players would turn the playing pieces 50*p* or 52*p* so that each player would be displaying the same or an opposite (similar) color so that the players could identify that they were playing the proper game.

EMBODIMENT OF FIG. 21

Figure 21:
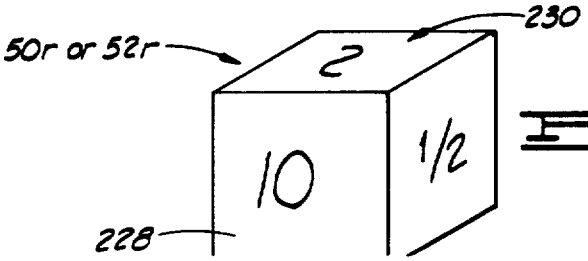
FIG. 21 is another modified playing piece.

Shown in FIG. 21 is a modified math playing piece 50*r* or 52*r*. The playing piece 50*r* or 52*r* includes a plurality of sides 228 (six sides being illustrated in FIG. 21 and only one of the sides being designated with the reference numeral 228). Each of the sides 228 has a different math indicia 230 disposed thereon (only one of the math indicia being designated with a reference numeral in FIG. 21).

Utilizing playing pieces constructed like the playing piece 50*r* or 52*r* shown in FIG. 21, the math game can be altered by simply turning the playing piece 50*r* or 52*r* so that a different side 228 having a different math indicia 230 is facing upwardly.

Each of the sides 220 of the playing piece 50*r* or 52*r* in FIG. 21 would be colored with a different color. In this manner, each of the players would move the playing piece 50*r* or 52*r* to a position wherein all of the playing pieces display the same color thereby assuring the players that the players were playing the proper game or, in other words, assuring the players that the correct math indicia 230 are shown for each of the first and the second playing pieces associated with a particular math game.

In one other embodiment, the playing math indicia on each of the playing pieces comprises a different, a distinct reference on each of the first and the second playing pieces and a plurality of corresponding references and a math indicia on a card or the like. For example, each of the first playing pieces may have a letter reference such as the letters A, B, C, D, E, F, G disposed thereon and each of the second playing pieces may have a letter reference such as the letters M, N, O, P, Q, R, S disposed thereon. In this example, the card would contain the letter references along with the playing math indicia corresponding to that letter reference, a sample card being constructed as follows:

| PLAYING PIECE | GAME NUMBER 1 | --- | n |
|---|---|---|---|
| A | 38 | | 5 |
| B | 12 | | 40 |
| C | 14 | | 17 |
| D | 48 | | 3 |
| E | 10 | | 20 |
| F | 20 | | 6 |
| G | 26 | | 4 |
| M | 38 | | 5 |
| N | 12 | | 40 |
| 0 | 14 | | 17 |
| P | 48 | | 3 |
| Q | 10 | | 20 |
| R | 20 | | 6 |
| S | 26 | | 4 |

In the above example, the card also includes a listing for a plurality of games with games 1 through n being shown in the sample card above. In this example, each of the players looks to the card and correlates the letter reference on the playing piece with the math indicia on the card under the game being played by the players. This allows a single reference to be utilized on the playing pieces which can be correlated to different math indicia depending upon which game is being played by the players. In addition, this example permits variations in the math games described herein such as designating each of the playing pieces with a reference corresponding to a scoring football player such as a quarterback or other sports type scoring player which could be designated "QB" for example in this last mentioned embodiment. The football designations would replace the letter designations shown in the sample card above. In this embodiment, the playing pieces may be statue like figures resembling the sports figure.

The term "playing math indicia disposed on the playing pieces" or words or terms of similar import as used herein is intended to encompass the variation of the math games just described where a reference is used on the playing pieces and the reference corresponds to math indicia contained on another source such as the sample card shown above.

The math games described and claimed herein may comprise physical embodiments of the game board and the playing pieces. On the other hand, the math games may be loadable into a computer and the game board and playing pieces may be displayed on a television screen or monitor. In this embodiment, the computer can be programmed to automatically display the playing math indicia reference numerals on the playing pieces corresponding to the game number selected in lieu of using the sample card and the reference letters in the embodiment described above. The claims in the present case are intended to encompass either physical embodiments of the math games or embodiments of the math games loadable into a computer as described before.

A plastic sheet may be attached to the underside of the game board and disposed between the game board and the math function board to prevent players from marking on the math function board.

Changes may be made in the construction and the operation of the various components, elements and assemblies described herein or in the steps or sequence of steps of the methods described herein without departing from the spirit and scope of the invention as defined in the following claims.

What is claimed is:

1. A math game comprising:

a game board having a plurality of defined spaces comprising goals with some of the goals being designated first home goals, some of the goals being designated second home goals and the remaining goals being designated field goals, the field goals being disposed between the first home goals and the second home goals;

a plurality of first goal math indicia, each first goal math indicia being disposed on the game board near and associated with one of the first home goals;

a plurality of second goal math indicia, each second goal math indicia being disposed on the game board near and associated with one of the second home goals;

a plurality of first playing pieces, each first playing piece being disposable on one of the first home goals at a start of game position;

a plurality of second playing pieces, each second playing piece being disposed on one of the second home goals at the start of game position, the first playing pieces being movable on at least some of the field goals to one of the second home goals and the second playing pieces being movable on at least some of the field goals to one of the first home goals, each first playing piece and each second playing piece having playing math indicia disposed thereon, each first playing piece being movable from the first home goal where said first playing piece initially is disposed sequentially onto one or more of the field goals and onto one of the second home goals and each second playing piece being movable from the second home goal where said second playing piece initially is disposed sequentially onto one or more of the field goals and onto one or more of the first home goals until all of the first playing pieces are disposed on the second home goals or all of the second playing pieces are disposed on one of the first home goals or until the first playing pieces and the second playing pieces no longer are movable on the game board in an end of game position, a score being totalled when the first and second playing pieces are at the end of game position and a score being the playing math indicia on the first playing piece or the second playing piece combined with the second goal math indicia or the first goal math indicia respectively where the first or second playing piece is disposed at the end of game position;

a game box, the game board being supported on the game box and the game box including a component space;

a math function board supported on the game box and disposed under the game board; and wherein the game board further comprises slots in the game board with each slot being associated with one of the first home goals or the second home goals, the math function board having a plurality of math indicia disposed thereon, and at least one of the game board and the math function board being movable to align one of the math indicia on the math function board with each slot in the game board, each math indicia aligned with one of the slots comprising one of the first or second goal math indicia; and roller means rollingly supported on the game box, the math function board being connected to the roller means and the roller means being rollingly movable to rollingly to move the math function board in a first direction or a second direction to align different math indicia on the math function board with the slots in the game board.

2. The math game of claim 1 wherein some of the goals are designated as third home goals and wherein the math game further comprises:

a plurality of third playing pieces, each third playing piece being disposed on one of the third home goals at the start of game position and each third playing piece being movable from the third home goal where said third playing piece initially is disposed on one or more of the field goals and onto one of the first home goals or the second home goals, each third playing piece having a playing math indicia disposed thereon and a score being the playing math indicia on the third playing piece combined with the first or the second math indicia associated with the first or the second home goal where the third playing piece is disposed at the end of game position, and wherein the first playing pieces are movable from the first home goal where the first playing piece initially is disposed sequentially onto one or more of the field goals and onto one or more of the second or third home goals with the score being the math indicia on the first playing piece combined with the second or third goal math indicia associated with the second or third home goal where the first playing pieces disposed at the end of game position, and wherein the second playing pieces each are movable from the second home goals where the second playing piece initially is disposed sequentially onto one or more of the field goals and onto one of the first or third home goals with a score being the playing piece math indicia on the second playing piece combined with the first goal math indicia or the third goal math indicia associated with the first or third home goal where the second playing piece is disposed at the end of game position.

3. The math game of claim 1 wherein some of the goals are designated as third home goals and wherein some of the goals are designated as fourth home goals with the field goals being disposed between the first and second home goals and between the third and fourth home goals, and wherein the math game further comprises:

a plurality of third playing pieces come each third playing piece being disposed on one of the third home goals at the start of game position and each third playing piece having a playing math indicia disposed thereon; and a plurality of fourth playing pieces, each fourth playing piece being disposed on one of the fourth home goals at the start of game position and each fourth playing piece having a playing math indicia disposed thereon, each first playing piece being movable from the first home goal where the first playing piece initially is disposed sequentially onto one or more of the field goals and onto one of the second, third or fourth home goals and a score being the playing math indicia on the first playing piece combined with the second, third or fourth goal math indicia associated with the second, third or fourth home goal where the first playing piece is disposed at the end of game position, each second playing piece being movable from the second home goal where the second playing piece initially is disposed sequentially on one or more of the field goals and onto one or more of the first, third or fourth home goals with a score being the playing math indicia on the second playing piece combined with the first, third or fourth goal math indicia associated with the first, third or fourth home goal where the second playing piece is disposed at the end of game position, each third playing piece being movable from the third home goal where the third playing piece initially is disposed sequentially onto one or more of the field goals and onto one or more of the first, second or fourth home goals with a score being the playing math indicia associated with third playing piece combined with the first, second or fourth goal math indicia associated with the first, second or fourth home goal where the third playing piece is disposed at the end of the game position, and each fourth playing piece being movable from the fourth home goal where said fourth playing piece initially is disposed sequentially onto one or more of the field goals and onto one of the first, second or third home goals with a score being the playing math indicia on the fourth playing piece combined with the first, second or third goal math indicia associated with the first, second or third home goal where the fourth playing piece is disposed at the end of game position.

4. The math game of claim 1 further wherein the goals on the game board are positioned in horizontal even rows and horizontal odd rows with each horizontal odd row being disposed between two horizontal even rows, each horizontal even row having an even number of goals disposed therein and each horizontal odd row having an odd number of goals disposed therein.

5. The math game of claim 4 wherein there are four goals in each horizontal even row and three goals in each horizontal odd row.

6. The math game of claim 4 wherein there are five goals in each horizontal even row and four goals in each horizontal odd row.

7. The math game of claim 4 wherein there are seven goals in each horizontal even row and six goals in each horizontal odd row.

8. The math game of claim 4 wherein there are six goals in each horizontal even row and five goals in each horizontal odd row.

9. The math game of claim 1 wherein each goal is connected to at least one other goal by way of diagonal lines defining playing paths and wherein the first and the second playing pieces are movable on the goals only along the playing paths.

10. The math game of claim 1 wherein the game board includes a sliding slot, and when the math game further comprises:

retaining pin means disposed through the sliding slot, the game board being movable over the math function board and the retaining pin means maintaining the game board connected to the math function board as the game board moves with respect to the math function board.

11. The math game of claim 1 wherein the game board is rectangularly shaped and has four corners and wherein one of the first playing pieces or second playing pieces is disposed at each of the four corners of the game board.

12. The math game of claim 1 wherein the first playing pieces each are defined further as having a front side and a second side, a first playing math indicia being disposed on the first side and a second playing math indicia being disposed on the second side of each of the first and the second playing pieces, the first and the second playing pieces being disposable on the game board in a position whereby only the playing math indicia on the front side or the playing math indicia on the back side is facing upwardly from the game board, different math games being playable by disposing the first and the second playing pieces on the math board for displaying the math indicia disposed on the front or the back side of the first or the second playing pieces.

13. A method for playing a math game comprising:

providing a game board having a plurality of defined spaces comprising goals with some of the goals being designated first home goals, some of the goals being designated second home goals and the remaining goals being designated field goals, the field goals being disposed between the first home goals and the second home goals, a plurality of first goal math indicia with each first goal math indicia being disposed on the game board near and associated with one of the first home goals, a plurality of second goal math indicia with each second goal math indicia being disposed on the game board near and associated with one of the second home goals;

providing a plurality of first playing pieces;

providing a plurality of second playing pieces;

disposing each of the first playing pieces on one of the first home goals at a start of game position;

disposing each of the second playing pieces on one of the second home goals at the start of game position;

moving sequentially each of the first playing pieces from the first home goals to at least some of the field goals and toward one of the second home goals;

moving sequentially each of the second playing pieces alternately with the moving of the first playing pieces from the second home goals to at least some of the field goals and toward the first home goals until the first and the second playing pieces have been positioned in an end of game position wherein either all of the first playing pieces are disposed on one of the second home goals or all of the second playing pieces are disposed on one of the first home goals or the first and the second playing pieces no longer are movable on the field goals toward one of the first and the second home goals; and determining a score for the first playing pieces by combining the math indicia on the first playing piece with the second goal math indicia associated with the second goal where the first playing piece is disposed at the end of game position; and determining the score of the second playing pieces by combining the math indicia on the second playing pieces with the first goal math indicia associated with each first home goal where each second playing piece is disposed at the end of game position.

14. The method of claim 13 wherein the step of determining the score of each first playing piece is defined further to comprise:

determining a penalty for each first playing piece by combining the math indicia on each first playing piece disposed on a goal other than a second home goal with a defined function and subtracting each penalty from the total score for the first playing pieces; and, determining a penalty for each second playing piece by combining the math indicia on each second playing piece disposed on a goal other than one of the first home goals with a defined function and subtracting each penalty from the score for the second playing pieces.

15. A math game comprising:

a game board having a plurality of defined spaces comprising goals with some of the goals being designated first home goals, some of the goals being designated second home goals and the remaining goals being designated field goals, the field goals being disposed between the first home goals and the second home goals;

a plurality of first goal math indicia, each first goal math indicia being disposed on the game board near and associated with one of the first home goals;

a plurality of second goal math indicia, each second goal math indicia being disposed on the game board near and associated with one of the second home goals;

a plurality of first playing pieces, each first playing piece being disposable on one of the first home goals at a start of game position;

a plurality of second playing pieces, each second playing piece being disposed on one of the second home goals at the start of game position, the first playing pieces being movable on at least some of the field goals to one of the second home goals and the second playing pieces being movable on at least some of the field goals to one of the first home goals, each first playing piece and each second playing piece having playing math indicia disposed thereon, each first playing piece being movable from the first home goal where said first playing piece initially is disposed sequentially onto one or more of the field goals and onto one of the second home goals and each second playing piece being movable from the second home goal where said second playing piece initially is disposed sequentially onto one or more of the field goals and onto one or more of the first home goals until all of the first playing pieces are disposed on the second home goals or all of the second playing pieces are disposed on one of the first home goals or until the first playing pieces and the second playing pieces no longer are movable on the game board in an end of game position, a score being totalled when the first and second playing pieces are at the end of game position and a score being the playing math indicia on the first playing piece or the second playing piece combined with the second goal math indicia or the first goal math indicia respectively where the first or second playing piece is disposed at the end of game position;

a game box, the game board being supported on the game box and the game box including a component space;

a math function board supported on the game box and disposed under the game board; and wherein the game board further comprises slots in the game board with each slot being associated with one of the first home goals or the second home goals, the math function board having a plurality of math indicia disposed thereon, and at least one of the game board and the math function board being movable to align one of the math indicia on the math function board with each slot in the game board, each math indicia aligned with one of the slots comprising one of the first or second goal math indicia; and a first roller rollingly supported on the game box and disposed in the component space; and a second roller rollingly supported on the game box and disposed in the component space, one end of the game function board being connected to the first roller and the opposite end of the game function board being connected to the second roller, the first or the second roller being rollingly movable to rollingly move the math function board in a first or a second direction to align the math indicia on the math function board with the slots in the game board.

16. A math game comprising:

a game board having a plurality of defined spaces comprising goals with some of the goals being designated first home goals, some of the goals being designated second home goals and the remaining goals being designated field goals, the field goals being disposed between the first home goals and the second home goals;

a plurality of first goal math indicia, each first goal math indicia being disposed on the game board near and associated with one of the first home goals;

a plurality of second goal math indicia, each second goal math indicia being disposed on the game board near and associated with one of the second home goals;

a plurality of first playing pieces, each first playing piece being disposable on one of the first home goals at a start of game position; and a plurality of second playing pieces, each second playing piece being disposed on one of the second home goals at the start of game position, the first playing pieces being movable on at least some of the field goals to one of the second home goals and the second playing pieces being movable on at least some of the field goals to one of the first home goals, each first playing piece and each second playing piece having playing math indicia disposed thereon, each first playing piece being movable from the first home goal where said first playing piece initially is disposed sequentially onto one or more of the field goals and onto one of the second home goals and each second playing piece being movable from the second home goal where said second playing piece initially is disposed sequentially onto one or more of the field goals and onto one or more of the first home goals until all of the first playing pieces are disposed on the second home goals or all of the second playing pieces are disposed on one of the first home goals or until the first playing pieces and the second playing pieces no longer are movable on the game board in an end of game position, a score being totalled when the first and second playing pieces are at the end of game position and a score being the playing math indicia on the first playing piece or the second playing piece combined with the second goal math indicia or the first goal math indicia respectively where the first or second playing piece is disposed at the end of game position;

a game box, the game board being supported on the game box and the game box including a component space;

a math function board supported on the game box and disposed under the game board; and wherein the game board further comprises slots in the game board with each slot being associated with one of the first home goals or the second home goals, the math function board having a plurality of math indicia disposed thereon, and at least one of the game board and the math function board being movable to align one of the math indicia on the math function board with each slot in the game board, each math indicia aligned with one of the slots comprising one of the first or second goal math indicia;

a first roller means rollingly supported on the game box with a portion of the first roller means disposed in the component space;

a second roller means rollingly supported on the game box with a portion of the second roller means disposed in the component space; and wherein the math function board comprises a continuous strip of material extending about the first and the second roller means, the first or the second roller means being rollingly movable to rollingly move the math function board in a first or a second direction for aligning the math indicia on the math function board with the slots in the game board.

17. A method for playing a math game comprising:

providing a game board having a plurality of defined spaces comprising goals with some of the goals being designated first home goals and some of the goals being designated second home goals, a plurality of first goal math indicia with each first goal math indicia being disposed on the game board near and associated with one of the first home goals, a plurality of second goal math indicia with each second goal math indicia being disposed on the game board near or associated with one of the second home goals;

providing a plurality of first playing pieces;

providing a plurality of second playing pieces;

disposing each of the first playing pieces on one of the first home goals at a start position;

disposing each of the second playing pieces on one of the second home goals at the start of the game position;

moving sequentially each of the first playing pieces from the first home goals toward one of the second home goals;

moving sequentially each of the second playing pieces alternately with the moving of the first playing pieces from the second home goals toward the first home goals until the first and the second playing pieces have been positioned in an end of the game position were in either all of the first playing pieces are disposed on one of the second home goals or all of the second playing pieces are disposed on one of the first home goals or the first and the second playing pieces no longer are moveable toward one of the first and the second home goals;

determining a score for the first playing pieces by combining the math indicia on the first playing piece with the second goal math indicia associated with the second goal where the first playing piece is disposed at the end of game position; and determining the score of the second playing pieces by combining the math indicia on the second playing pieces with a first goal math indicia associated with each first home goal where each second playing piece is disposed at the end of game position.

18. The method of claim 17 wherein the step of determining the score of each first playing piece is defined further to comprise:

determining a penalty for each first playing piece by combining the math indicia on each first playing piece disposed on a goal other than a second home goal with a defined function and subtracting each penalty from the total score from the first playing pieces; and determining a penalty for each of second playing piece by combining the math indicia on each second playing piece disposed on a goal other than one of the first home goals with a defined function and subtracting each penalty from the score for the second playing pieces.

* * * * *

UNITED STATES PATENT AND TRADEMARK OFFICE

CERTIFICATE OF CORRECTION

PATENT NO. : 5,149,102

DATED : September 22, 1992

INVENTOR(S) : Bernard W. McGowan, et al

It is certified that error appears in the above-indentified patent and that said Letters Patent is hereby corrected as shown below:

Column 20, line 48, after pieces, please insert the words--with each first playing piece having a math indicia on or associated therewith--.

Column 20, line 49, after pieces, please insert the words--with each first playing piece having a math indicia on or associated therewith--.

Column 20, line 63, please delete the words "were in" and substitute therefore the word--wherein--.

Column 21, line 2, after on, please insert the words--or associated with--.

Column 21, line 3, please delete the word "piece" and substitute therefore the word --pieces--.

UNITED STATES PATENT AND TRADEMARK OFFICE

CERTIFICATE OF CORRECTION

PATENT NO. : 5,149,102

DATED : September 22, 1992

INVENTOR(S) : Bernard W. McGowan, et al

It is certified that error appears in the above-indentified patent and that said Letters Patent is hereby corrected as shown below:

Column 21, line 7, after the word on, please insert the words--or associated with--.

Column 21, line 8, please delete the word "a" and substitute therefore the word--the--.

Column 22, line 2, after the word on, please insert the words --or associated with--.

Column 22, line 8, after the word on, please insert the words --or associated with--.

Signed and Sealed this

Fourteenth Day of March, 1995

*Attest:*

*Attesting Officer*

BRUCE LEHMAN

*Commissioner of Patents and Trademarks*